United States Patent [19]

Nestor

[11] 4,045,650

[45] Aug. 30, 1977

[54] JUMPER TOUCH SENSOR CURRENT SWITCHING DEVICE

[75] Inventor: Charles R. Nestor, Niles, Ohio

[73] Assignee: General Motors Corporation, Detroit, Mich.

[21] Appl. No.: 653,300

[22] Filed: Jan. 29, 1976

[51] Int. Cl.[2] ..... H01H 3/00

[52] U.S. Cl. ..... 200/153 K; 200/61.43; 200/67 G; 200/243; 200/264; 200/339

[58] Field of Search ..... 200/5 A, 61.43, 67 G, 200/85 R, 86 R, 153 K, 159, 243, 264, 339

[56] References Cited

U.S. PATENT DOCUMENTS

| | | | |
|---|---|---|---|
| 1,915,292 | 6/1933 | Conklin | 200/86 R |
| 2,681,962 | 6/1954 | Sundt | 200/339 X |
| 3,051,803 | 8/1962 | Brown | 200/243 X |
| 3,133,167 | 5/1964 | Miller | 200/61.43 |
| 3,343,624 | 9/1967 | Shaheen | 200/85 R X |
| 3,529,109 | 9/1970 | Cross | 200/153 K |
| 3,591,747 | 7/1971 | Dennison | 200/153 K |
| 3,704,353 | 11/1972 | Fontaine | 200/85 R |
| 3,746,809 | 7/1973 | Gaber | 200/67 G |
| 3,892,934 | 7/1975 | Richards | 200/243 X |
| 3,911,234 | 10/1975 | Kotaka | 200/5 A |

*Primary Examiner*—Volodymyr Y. Mayewsky
*Attorney, Agent, or Firm*—J. C. Evans

[57] ABSTRACT

A current switching device for use in printed circuit board application includes a terminal contact board sandwiched with respect to a foamed spring pad that supportingly receives a pivotal contactor plate in juxtaposed relationship therewith and wherein the switch includes a rotatable rocker engageable with the contactor plate and pivotal to cause the contactor plate to be shifted into electrical bridging engagement with the terminal board and wherein the foamed pad yields in both compression and shear to produce a bias on the contactor plate for return thereof to a spaced relationship with the terminal board when the rocker is in a neutral position.

5 Claims, 8 Drawing Figures

JUMPER TOUCH SENSOR CURRENT SWITCHING DEVICE

This invention relates to current switching devices and more particularly to devices utilizing a compressible foam pad for controlling the position of a contactor plate with respect to terminal contacts of the switching device.

Various switching devices have been proposed wherein contactor elements are located in spaced relationship with respect to terminal points on the switch by means of a compressible foam element. In such cases the contactor elements are electrically insulated from the terminal points of the switch by the foam element which is compressible to cause the contact elements to be moved into electrical engagement with the terminals for completing electrical circuits through the switch. In such arrangements the compressible pad is yieldable in compression to complete the electrical contact and will serve to return the contactor elements to a neutral position out of electrical contact with the terminals following a switching operation.

In certain electrical switching operations, for example, in the case of switching devices that are utilized in automotive applications for use in association with printed circuit boards, it is desirable to provide a simple reliable current switching device that is easily associated with printed circuit paths for completing circuits across electrically energizable light bulbs or to complete energization circuits for relays and the like. Furthermore, it is desirable that the switch be compact and manually operable between neutral and plural switching positions. Furthermore, it is desirable that the current switching device be of varied types including latching switches, on-off switches, neutral center switches and the like merely by varying contactor and rocker components of the switch.

Accordingly, an object of the present invention is to provide an improved, simplified reliable current switching device that includes stacked juxtaposed components including a terminal board, yieldable foam switch spring pad and contactor plate disposed in spaced parallelism within a switch housing and wherein a rocker element is supported for pivotal movement on the switch housing and positionable with respect to the contactor plate to operate it to cause the foam pad to yield both in shear and compression thereby to produce a combined wiping movement of the contactor plate with respect to terminal contacts on the board and to direct an unbalanced spring bias on the contactor plate for return thereof to a spaced parallelism with the terminals when the rocker element is in a neutral position.

Still another object of the present invention is to provide an easily assembled simplified manually operable switch including a flat terminal board supported on the base of the switch housing and in juxtaposed relationship with a compressible pad having a flat plate electrical contactor in juxtaposed supported relationship therewith and maintained by the pad in a spaced electrically insulated relationship with the terminal board and wherein the switch further includes a rocker element pivotally supported on the switch housing and movable between a neutral position and a switch actuating position and including means engageable with the contactor plate to maintain it in spaced parallel relationship with the terminal board with the pad being compressed therebetween and movable to switch operating positions wherein the contactor plate is shifted with respect to the terminals so as to cause the pad to yield in both compression and shear to produce a combined wiping action of the contactor plate with respect to terminals on the terminal board and to produce an unbalanced spring bias on the contactor plate for returning it to a spaced parallel relationship to the contactor terminal when the rocker arm is moved into its neutral position.

Still another object of the present invention is to provide an easily assembled manually operable switch for association with a printed circuit board including an extension from the printed circuit board in the form of a terminal board having spaced-apart electrical conductor strips thereon supported on the base of the switch by means of an elastomeric back plate, and wherein a compressible foam pad is supported on the board in juxtaposed relationship therewith and with a contactor plate being supported on an opposite side of the pad in spaced relationship to the terminal board and wherein a pivot element is directed through the back plate, terminal board and the foam pad to define a pivot point for the contactor plate with the switch further including a rocker member engageable with the contactor plate at opposite ends thereof and wherein the pad is maintained in compression between the contactor plate and terminal board when the rocker arm is in a neutral position to electrically insulate the contactor plate from the terminal board and with the rocker member being pivotal to shift the contactor plate on either side of the pivot point to cause the compressible pad to yield both in compression and shear to cause wiping action of the contactor plate across the terminal board upon electrical contact therewith produced by momentary manual operation of the rocker element with the pad thereafter maintaining an unbalanced spring bias force on the contactor plate for returning it to a neutral position when the momentary manual switch operating force is removed from the rocker member.

Yet another object of the present invention is to provide an improved, simplified plural position latching switch for association with printed circuit board components including a printed circuit board terminal segment and a compressible foam pad located in juxtaposed relationship with the printed circuit board terminal segment and including a flat plate contactor normally maintained out of electrical contact with the printed circuit board by the foam pad and wherein a rocker arm switch actuator is pivotally supported on a switch housing, the actuator including a spring loaded pin engageable with a central pivot recess on the contactor plate to maintain the pad compressed between the contactor and terminal segment to maintain a spaced electrically insulated relationship therebetween and wherein the rocker arm is pivotal between the neutral position and a switch actuating position to cause the spring loaded pin to shift across the contactor plate to force it into electrical contact with the printed circuit board to cause the pad to yield both in compression and shear so as to produce a restoring force on the contactor plate to return it to its neutral position when the rocker arm is moved to a neutral position.

Further objects and advantages of the present invention will be apparent from the following description, reference being had to the accompanying drawings wherein a preferred embodiment of the present invention is clearly shown.

Figure 1:
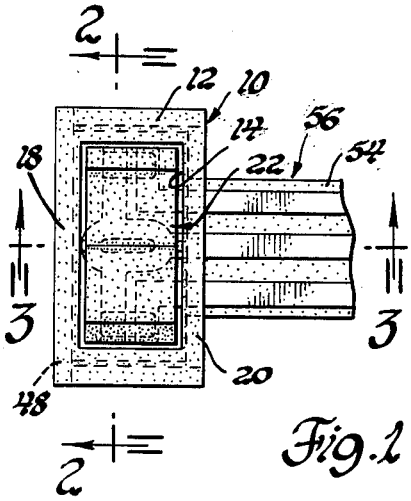
FIG. 1 is a view in elevation of a first embodiment of the present invention.
Figure 4:
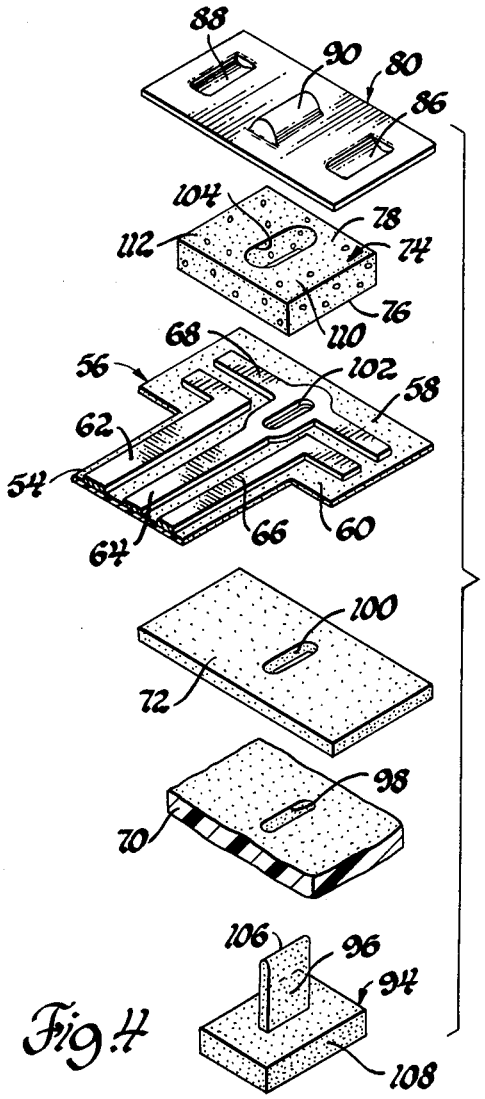
FIG. 4 is an exploded perspective view of operative component parts of the switching device in FIG. 1.
Figure 3:
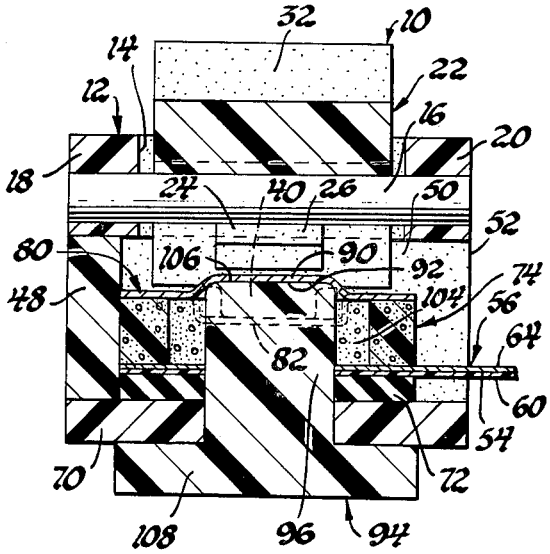
FIG. 3 is an enlarged vertical sectional view along the line 3—3 of FIG. 1 looking in the direction of the arrows.

Referring now to the drawings, in FIG. 1 a jumper touch sensor, current switching device 10 is illustrated including a front housing portion 12 of rectangular configuration including a rectangular opening 14 therein and a pivot pin 16 connected between side walls 18, 20 of the front 12. The pin 16 bridges the opening 14 and defines a pivot support for a rocker member 22 including a center segment 24 with a slot 26 therein that receives the pivot pin 16. The rocker member 22 includes spaced apart legs 28, 30 each having a frontal surface 32, 34 and curvilinear end portion 36, 38, respectively. The portions 36, 38 form a transition from the frontal surfaces 32, 34 to rounded tip portions 40, 42 of the legs 28, 30. The tip portions 40, 42 are located inboard of housing side walls 44, 46 and a stop plate 48 that extends transversely of the housing 12 between the sidewall members 44, 46. Together, the sidewalls 44, 46 and stop plate 48 define a switch cavity 50 that has a side opening 52 from which a side extension 54 of a printed circuit board 56 extends. The printed circuit board 56 includes a terminal board end segment 58 that is formed as a tee across the side extension 54 as best seen in FIG. 4. It includes an electrically insulated layer 60 having a plurality of electrically conductive strips 62, 64 and 66 thereon. The conductive strip 64 includes a transverse segment 68 thereon following the tee configuration of the side extension 54 and end segment 58. Each of the conductive strips 62, 66 is of L-configuration. As a result, the conductive strips 62, 68 are spaced apart within the switching cavity 50 to form a first pair of terminals on the circuit board 56 and the conductive strips 66, 68 likewise form a second pair of contact terminals within the cavity 50 on the opposite side of the aforementioned pair of terminal contacts.

In the illustrated arrangement, circuit board 56 is supported within the cavity 50 by a base member 70 secured to the sidewalls 44, 46. It supportingly receives an elastomeric back element 72 having a planar extent congruent with that of the end segment 58 of the circuit board 56 so as to provide a resilient back-stop for the circuit board within the cavity 50.

Figure 2:
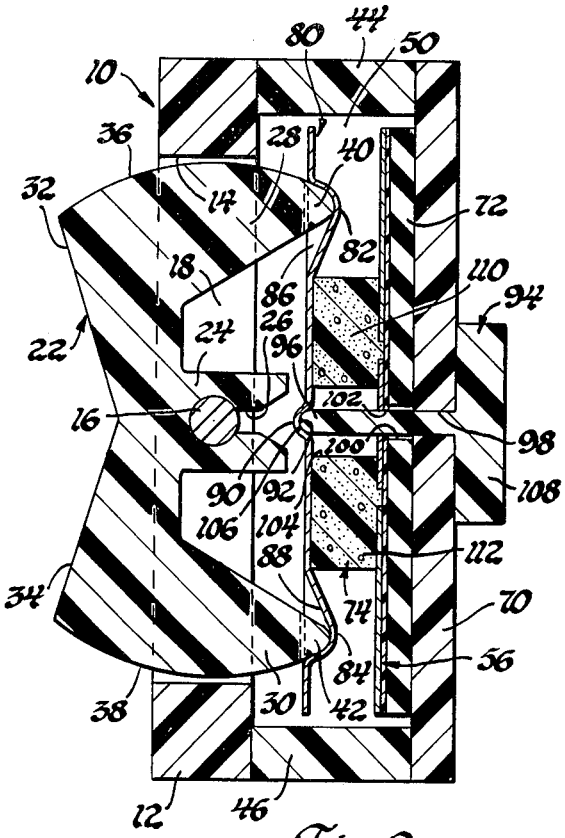
FIG. 2 is an enlarged vertical sectional view along the line 2—2 of FIG. 1 looking in the direction of the arrows.

In accordance with certain principles of the present invention, a resilient foam pad 74 has one surface 76 thereon located in juxtaposed overlying relationship with the end segment 58. It has a length, as seen in FIG. 2, less than that of the conductive strips 62, 68 and 66 through the transverse extent thereof within the cavity 50. The pad 74 further includes an opposite surface 78 thereon that supportingly receives an electrically conductive contactor plate 80 in supported juxtaposed relationship therewith as seen in FIG. 2. The contactor plate 80 is of flat rectangular configuration having a pair of inwardly directed segments 82, 84 thereon defining dimpled seats 86, 88 on the outboard surface of the contactor plate 80 and arranged to supportingly receive the tip portions 40, 42 of the rocker member 22. Additionally, the contactor plate 80 includes an outwardly struck segment 90 thereon defining an inboard pivot point 92.

The back element 72, end segment 58, pad 74 and contactor plate 80 are located in a sandwiched relationship that is readily insertable through the side opening 52 into the cavity 50. These elements are fixedly secured within the cavity 50 by means of a retainer 94 including an elongated stem 96 that extends through aligned openings 98, 100, 102, 104 in the base member 70, resilient back element 72, end segment 58, and pad 74, respectively. A rounded tip 106 on the elongated stem 96 is seated within the pivot point 92 and located with respect thereto by a head portion 108 on the retainer 94 that is seated against the outer surface of the base member 70 as shown in FIG. 2.

When the elements are sandwiched and inserted into the cavity 50 and retained in place therein by the element 94 and the rocker member 22 is fit on the pivot pin 16, the dimensional relationship between the tip portions 40, 42 and the inner surface of the base member 70 are such that pad 74 is maintained in compression. Side segments 110, 112 of the pad 74 are formed equidistantly on either side of the pivot point 92 and the pad 74 thereby effects a balanced spring action on the contactor plate 80 and thereby on the rocker member 22 to maintain it in a neutral centered position. The neutral position represents a first operative position wherein the contactor plate 80 has the inwardly formed segments 82, 84 thereon located in spaced relationship to the contact terminals on the end segment 58. In this switch position the pairs of terminal contacts on the end segment 58 are in open circuit relationship. It will be noted that the arrangement eliminates the need for separate terminals, wires, switch contacts and operator springs in the assembly.

The jumper touch sensor current switching device 10 includes a pair of circuit completion positions. The circuits are completed by bridging of the conductive strips 62, 68 on one side of the segment 58 and the conductive strips 66, 68 on the opposite side of the end segment 58 by segments 82, 84 on the contactor plate, respectively. Since the circuits are completed by a bridging action of the contactor plate 80, the arrangement eliminates the need for an electrical feed to the contactor plate 80. This further simplifies the geometric configuration of the switching device 10.

One circuit is completed across the switch 10 by applying an unbalanced force on the frontal surface 34 causing the rocker member 22 to pivot in a counterclockwise direction about the pivot pin as viewed in FIG. 2. The unbalanced force will cause the contactor plate 80 to pivot about the tip 106 of the retainer 94 and will concurrently cause the foam pad 74 to yield both in compression and shear. The side portion 112 of the pad 74 will compress until the end segment 84 engages the spaced apart conductive strips 62, 68 on one side of the end segment 58. As soon as contact between the segment 84 and the strips occurs, the tip portion 42 will act against the seat 88 in a transverse direction to cause a slight shifting motion of both the contactor plate 80 and the pad 74 upwardly as viewed in FIG. 2 to produce wiping action of the contactor segment 84 with respect to the conductive strips 62, 68 to produce an electrical bridge thereacross with a resultant completion of one energization circuit.

When a momentary unbalanced force is released from the frontal surface 34, the pad 74 will produce an unbalanced force on the contactor plate 80 to return it and the rocker member 22 to the neutral position shown in FIG. 2.

Completion of a second electrical circuit across the conductor strips 66 and 68 is completed in a like fashion by imposing an unbalanced force on the frontal surface 32 which will cause clockwise rotation of the rocker 22, as viewed in FIG. 2, and a reverse movement of the contactor plate 80. This produces a resultant compression of the side segment 110 of the pad 74 along with a wiping action of segment 82 against strips 66, 68. The pad 74 is again yieldable both in compression and shear as the bridging segment 82 of the contactor plate 80 is moved into bridging relationship with the conductive strips 66, 68 on the opposite side of the end portion 58 to complete a second electrically energized circuit through the switching device 10. Upon release of the unbalanced force on the frontal surface 32, the pad 74 produces an unbalanced bias on the contactor plate 80 to return both it and the rocker 22 to the aforedescribed neutral position as shown in FIG. 2.

The back element 72 of elastomeric material enables the circuit board end segment 58 to yieldably adjust to the bridging contact of the contactor plate 80 as described above. Furthermore, the stacked juxtaposed relationship of elements enables the back element 72, foam pad 74 and contactor plate 82 to be bonded together as a unit for insertion into the cavity 50 through the side opening 52 thereof thereby to facilitate installation of the component parts of the switch.

The embodiment of the invention as set forth in FIGS. 1 through 4 is directed to a momentary, touch sensor switching device having a neutral center position and first and second circuit completion positions on either side of neutral as described above. The inventive relationship of juxtaposed circuit board segments, switch controlling foam pad and contactor elements arranged for compact disposition within a switch cavity and insertable as a unit are also adaptable for a variety of other types of current switching applications. For example, a second embodiment of the invention is set forth in FIGS. 5 through 7. It is in the form of a neutral center up and down latch switch device 114. As in the case of the first embodiment it includes a front 116 having a rectangular opening 118 thereon. The front 116 has a pair of spaced apart dowel pins on opposite side walls thereof corresponding to side walls 18, 20 in the first embodiment. In the views shown in FIGS. 5 and 7 one of the dowel pins 120 is shown on a side wall 122 with it being understood that a like dowel pin and side wall are provided on the opposite side of the cavity 118. The dowel pins pivotally support a rocker 124 by being directed into side openings thereof. The rocker 124 includes a pair of outwardly inclined frontal surfaces 126, 128 and curved end segments 130, 132 on opposite ends thereof. The rocker 124 further includes an inboard tubular extension 134 thereon having a central bore 136 in which a pin 138 is slidably received. Pin 138 has an outboard located, spherical head 140 thereon. The head 140 is spring biased outwardly of the bore 136 by a compression spring 142. As best seen in FIG. 6, the pin 138 is located midway of a switch cavity 144 formed between side walls 146, 148 of the switch device 114 joined together by a side stop 150. The stop 150, side walls 146, 148 have a continuous groove 152 formed therearound which slidably supports a rocker stop member 154 having a generally U-shaped configuration as best seen in FIG. 6. The rocker stop member 154 includes spaced apart side segments 156, 158 that are arranged to selectively engage stop surfaces 160, 162 on opposite sides of the rocker 124.

In this embodiment of the invention the basic switching components are like those shown in the embodiments of FIGS. 1 through 4. More particularly, they include a base 163 of the switch 114 that supportingly receives an elastomeric back element 164 of a planar extent to correspond to the end segment 166 of a printed circuit board 168 that includes a side extension 170 thereon extending through a side opening 172 from the switch cavity 144 as best seen in FIG. 6. The circuit board includes a plurality of electrically conductive strips 174, 176, 178 thereon of a form corresponding to the conductive strips in the first embodiment. The circuit board 168 supportingly receives surface 180 of a foam pad 182 of modified form that has a pair of openings 184, 186 formed therethrough on either side thereof.

An opposite surface 188 of the pad 182 supportingly receives a contactor plate 190 of electrically conductive material. In this configuration the contactor plate 190 includes inwardly deformed dimples 192, 194 adjacent opposite ends thereof, respectively. Dimples 192, 194 extend transversely across the width of the contactor plate 190 and through the lateral extent of the openings 184, 186 so as to define ridge-like bridge segments for completion of circuits through the spaced apart conductive strips 174, 176 and/or 176, 178. In this embodiment the base 163 of the switch device 114 has a pair of spaced apart pins 196, 198 thereon that are directed through aligned openings 199, 203 formed respectively in the sandwiched juxtaposed back element 164, pad 182 and contactor plate 190 for securing the switch components within the cavity 144.

Figure 5:
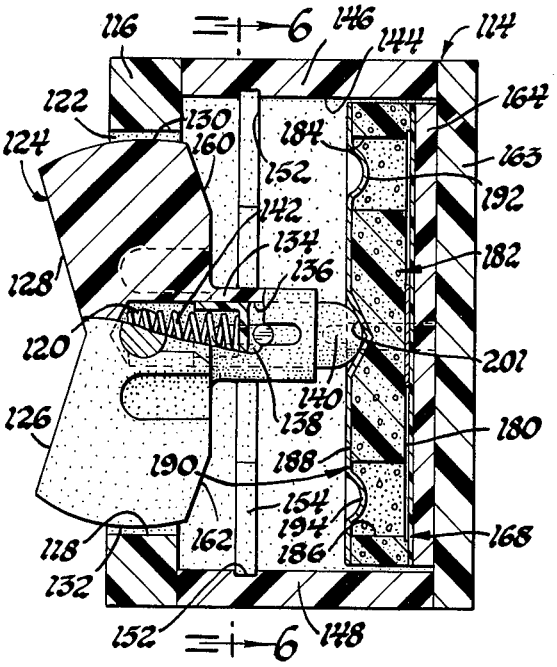
FIG. 5 is a vertical sectional view of a second embodiment of the present invention.
Figure 6:
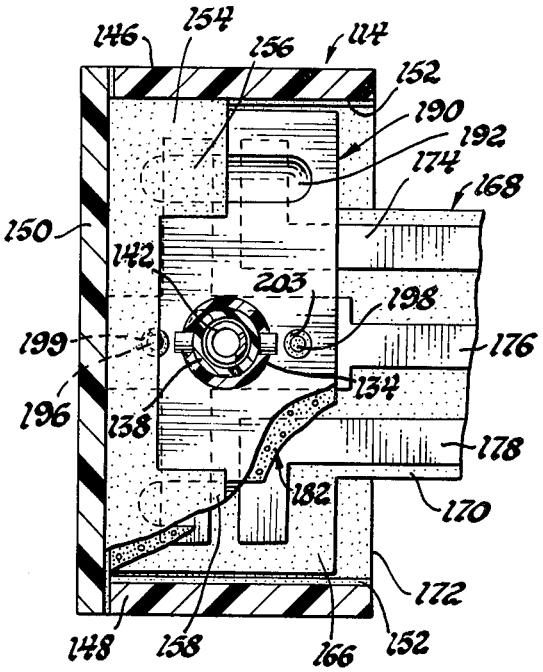
FIG. 6 is a cross-sectional view taken along the line 6—6 of FIG. 5 looking in the direction of the arrows.

The contactor plate 190 further includes a centrally located, outwardly facing recess 204 which supports the spherical head 140 of the pin 138 when the switching device 114 is in an unlatched neutral position as shown in FIG. 5. In this position, the pad 182 is maintained in compression but exerts a balanced force on the rocker 124 whereby the bridging segments 192, 194 of the contactor 190 are located in spaced, electrically insulated relationship with respect to the contact terminals defined by the conductive strips 174, 176, 178 of the printed circuit board 168.

Figure 7:
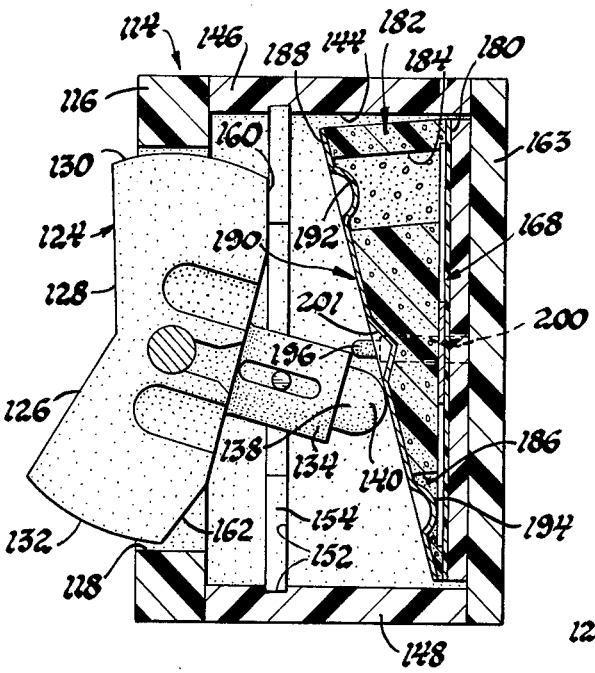
FIG. 7 is a vertical sectional view of the switch shown in FIGS. 5 and 6 in a circuit completion position.

When the rocker is in an up position as shown in FIG. 7, an unbalanced force is exerted on the frontal surface 128 causing the rocker to pivot in a clockwise direction until the stop surface 160 engages the rocker stop side segment 156. At this point the spherical head 140 is shifted outwardly of the recess 201 and is maintained in engagement with the outboard surface of the contactor plate 190 to one side of the recess 201 to produce a resultant compression of the pad 182 in the vicinity of the opening 186 thereof and a relaxation of the pad 182 in the vicinity of the opening 184 thereon as best seen in FIG. 7. The resultant force of the spring biased pin 138 on the contactor plate 190 latches the contactor plate 190 in an inclined relationship with respect to the printed circuit board 168 and will maintain the bridge segment 194 thereon in electrical contact across the conductive strips 176, 178 to complete a first electrical circuit.

Conversely, when the rocker 124 is in a down position an unbalanced force is exerted on the frontal surface 126 and the rocker 124 will rotate counterclockwise until the stop surface 162 engages the rocker stop 154. At this point, the spring biased pin 138 will produce a resultant force that will compress the pad 182 in the vicinity of the opening 184 so as to press the bridge segment 192 against and across the conductive strip 174, 176 to complete a second electrical circuit. Again the resultant force is such that the rocker switch is latched in the down position until a restoring force is applied against the rocker 124 to move it to the neutral position as seen in FIG. 5.

Figure 8:
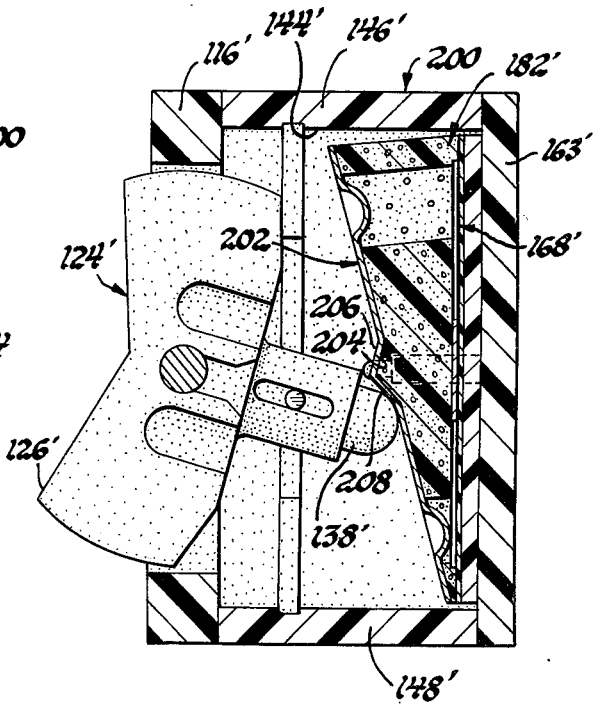
FIG. 8 is a vertical sectional view of a third embodiment of the present invention shown in a circuit completion position.

Still another embodiment of the present invention is illustrated in FIG. 8. This switch is a two-position latching switch 200. Parts corresponding to those shown in FIGS. 5 and 6 are marked with prime numerals and have the same form and function as those like parts previously described. In this arrangement, a contactor plate 202 has an angled recess 204 stamped outboard of the switch cavity 144' as shown in FIG. 8. It defines two inclined surfaces 206, 208 that define side abutments for the pin 138' of the rocker 124'. When the angled recess 204 is stamped outboard the switch either assumes the up or down positions but is unable to assume a neutral center position since the pin 138' will cause the rocker to slip either on one side or the other of the inclined surfaces 206, 208. The up switch position is shown in FIG. 8 corresponding to that shown in FIG. 7. A down switch position is assumed by applying an unbalanced force to the frontal surface 126'. This causes the pin 138' to slip up the ramp surface 208 and then slide back down surface 206 to compress the pad in an opposite direction to that shown in FIG. 8.

While the embodiments of the present invention, as herein disclosed, constitute a preferred form, it is to be understood that other forms might be adopted.

The embodiments of the invention in which an exclusive property or privilege is claimed are defined as follows:

1. A printed circuit board switch comprising a housing having a cavity therein with a side opening, a cavity base, a planar printed circuit board having an end segment and a side extension, means forming spaced apart electrical conductor strips on said end segment and said side extension, means for electrically insulating said strips from each other and said housing, said end segment being juxtaposed with said cavity base and having a planar extent substantially congruous with that of said cavity base, said side extension being directed through said side opening for electrical connection of said conductor strips external of said housing, an electrically conductive contactor plate with straight unbent ends located within said cavity having a center pivot and contact ridges formed on said straight unbent ends thereof, a flexible pad of foamed electrical insulating material secured to the underside of said contactor plate and juxtaposed against said end segment to electrically insulate said plate from said conductor strips and actuator means bearing against said contactor plate to produce a neutral position compression of said pad, said actuator means being operative to shift said contactor plate into first and second pivoted positions to cause said contact ridges thereon to initially contact and then shift laterally of said conductor strips to produce a wiping action thereacross said pad yielding in shear to accommodate said lateral shift and in compression to produce an unbalanced force on said contactor plate for return thereof to a neutral position when said actuator means is released.

2. A printed circuit board switch comprising a housing having a cavity therein with a side opening, a cavity base, a planar printed circuit board having an end segment and a side extension, means forming spaced apart electrical conductor strips on said end segment and said side extension, means for electrically insulating said strips from each other and said housing, said end segment being juxtaposed with said cavity base and having a planar extent substantially congruous with that of said cavity base, said side extension being directed through said side opening for electrical connection of said conductor strips external of said housing, an electrically conductive contactor plate located within said cavity having a center pivot and contact ridges formed on straight unbent opposite ends thereof, a flexible pad of foamed electrical insulating material secured to the underside of said contactor plate and juxtaposed against said end segment to electrically insulate said plate from said conductor strips, a rocker member, means pivotally mounting said rocker member on said housing to bear against said contactor plate to produce a neutral position compression of said pad, means defining a center fulcrum for said rocker member, said rocker member being operative to shift said contactor plate into first and second pivoted positions about said fulcrum to cause said contact ridges thereon to initially contact and then shift laterally of said conductor strips to produce a wiping action thereacross, said pad yielding in shear to accommodate said lateral shift and in compression to produce an unbalanced force on said contactor plate for return thereof to a neutral position when said rocker member is released.

3. A printed circuit board switch comprising a housing having a cavity therein with a side opening, a cavity base, a planar printed circuit board having an end segment and a side extension, means forming spaced apart electrical conductor strips on said end segment and said side extension, means for electrically insulating said strips from each other and said housing, said end segment being juxtaposed with said cavity base and having a planar extent substantially congruous with that of said cavity base, said side extension being directed through said side opening for electrical connection of said conductor strips external of said housing, an electrically conductive contactor plate located within said cavity having a center pivot and contact ridges formed on opposite straight unbent ends thereof, a flexible pad of foamed electrical insulating material secured to the underside of said contactor plate and juxtaposed against said end segment to electrically insulate said plate from said conductor strips, a rocker member, means pivotally mounting said rocker member on said housing, means including a spring biased pin on said rocker member bearing against said contactor plate at the center pivot thereof to produce a neutral position compression of said pad, said rocker member being operative to shift said pin from said contactor plate center pivot to move said contactor plate into first and second pivoted positions about said fulcrum to cause said contact ridges thereon to initially contact and then shift laterally of said conductor strips to produce a wiping action thereacross, said spring biased pin serving to latch said contactor plate in said first and second pivoted positions, said pad yielding in shear to accommodate said lateral shift and in compression to produce an unbalanced force on said contactor plate for return thereof to a neutral position when said rocker member is released.

4. A printed circuit board switch comprising a housing having a cavity therein with a side opening, a cavity base, a planar printed circuit board having an end segment and a side extension, means forming spaced apart electrical conductor strips on said end segment and said side extension, means for electrically insulating said strips from each other and said housing, said end segment being juxtaposed with said cavity base and having a planar extent substantially congruous with that of said cavity base, said side extension being directed through said side opening for electrical connection of said conductor strips external of said housing, an electrically conductive contactor plate located within said cavity having a center pivot and contact ridges formed on opposite straight, unbent ends thereof, a flexible pad of foamed electrical insulating material secured to the underside of said contactor plate and juxtaposed against said end segment to electrically insulate said plate from said conductor strips, a rocker member, means pivotably mounting said rocker member on said housing, means including a spring biased pin on said rocker member, said center pivot being formed as an outwardly directed ridge with inclined surfaces on either side thereof, said pin engaging said contactor plate on either side of said ridge to shift said contactor plate into first and second pivoted positions about said center pivot to cause said contact ridges thereon to initially contact and then shift laterally of said conductor strips to produce a wiping action thereacross, said pad yielding in shear to accommodate said lateral shift and in compression to produce an unbalanced force on said contactor plate for return thereof to a neutral position when said actuator means is released.

5. A printed circuit board switch comprising a housing having a cavity therein with a side opening, a cavity base, a resilient backing plate on said base, a planar printed circuit board having an end segment and a side extension, means forming spaced apart electrical conductor strips on said end segment and said side extension, means for electrically insulating said strips from each other and said housing, said end segment being juxtaposed with said backing plate and having a planar extent substantially congruous with said backing plate, said side extension being directed through said side opening for electrical connection of said conductor strips external of said housing, an electrically conductive contactor plate with straight unbent ends located within said cavity having a center pivot and contact ridges formed on opposite ones of said ends, means for securing said housing, backing plate and end segment together as a unit, said means including fulcrum means for supporting said contactor plate at the pivot thereon for pivotal movement within said cavity to cause selective engagement of said contact ridges with said end segment to complete a circuit across said spaced conductor strips and wherein said backing plate yields to prevent wear at said strips, a flexible pad of foamed electrical insulating material secured to the underside of said contactor plate and juxtaposed against said end segment to electrically insulate said plate from said conductor strips and having a planar extent to either side of said fulcrum means, and actuator means bearing against said contactor plate to produce a neutral position compression of said pad, said actuator means being operative to shift said contactor plate into first and second pivoted positions about said fulcrum to cause said contact ridges thereon to initially contact and then shift laterally of said strips to produce a wiping action thereacross, said pad yielding in shear to accommodate said lateral shift and in compression to produce an unbalanced force on said contactor plate for return thereof to a neutral position when said actuator means is released.

* * * * *